US005813441A

United States Patent [19]

Dewispelaere

[11] Patent Number: 5,813,441

[45] Date of Patent: Sep. 29, 1998

[54] SHED FORMING DEVICE FOR A TEXTILE MACHINE WITH ACTUATOR MEANS

[75] Inventor: Andre Dewispelaere, Kortrijk/Marke, Belgium

[73] Assignee: N.V. Michel Van de Wiele, Kortrijk/Marke, Belgium

[21] Appl. No.: 835,416

[22] Filed: Jun. 27, 1997

[51] Int. Cl.[6] ..... D03C 3/24

[52] U.S. Cl. ..... 139/455

[58] Field of Search ..... 139/455

[56] References Cited

U.S. PATENT DOCUMENTS

| | | | |
|---|---|---|---|
| 4,702,286 | 10/1987 | Palau et al. | 139/455 |
| 5,038,837 | 8/1991 | Palau et al. | 139/455 |
| 5,275,211 | 1/1994 | Roth | 139/455 |
| 5,333,652 | 8/1994 | Bassi et al. | 139/455 |
| 5,392,818 | 2/1995 | Seiler et al. | 139/455 |

FOREIGN PATENT DOCUMENTS

| | | |
|---|---|---|
| 0214075 | 3/1987 | European Pat. Off. . |
| 0399930 | 11/1990 | European Pat. Off. . |
| 0439440 | 7/1991 | European Pat. Off. . |
| 0544527 | 6/1993 | European Pat. Off. . |
| 0697477 | 2/1996 | European Pat. Off. . |
| 1380967 | 7/1993 | France . |
| 2809248 | 9/1979 | Germany . |
| 8705603 | 6/1987 | Germany . |
| 3090646 | 4/1991 | Japan . |
| 8701142 | 2/1987 | WIPO . |

*Primary Examiner*—Andy Falik

*Attorney, Agent, or Firm*—James Creighton Wray; Meera P. Narasimhan

[57] ABSTRACT

Shed forming device for a textile machine having at least one upwardly and downwardly moving shed forming mechanism. An actuator is connected to a movable holding element for moving the element to a holding position and a non-holding position. In the holding position the element holds the shed forming device at a fixed height. A stop is connected to the element for supporting the holding element when it is in the holding position. Because of this the holding element is held on the stop by the shed forming mechanism. Thus, the contact pressure between the shed forming means and the holding element is produced by the hook load itself allowing for a support for the holding element to remain unstressed.

13 Claims, 2 Drawing Sheets

SHED FORMING DEVICE FOR A TEXTILE MACHINE WITH ACTUATOR MEANS

BACKGROUND OF THE INVENTION

The invention relates to a shed forming device for a textile machine, such as for example a weaving machine or a knitting machine, provided with at least one shed forming mechanism, comprising a shed forming means provided in order to perform an upward and downward movement, a movable holding element that can be brought by an actuator into a holding position and into a non-holding position, and a stop for the holding element brought into the holding position, while the holding element is foreseen for holding the shed forming means at a fixed height in its holding position.

In the German patent DE-4309983 with reference to FIG. 4, such a shed forming device for a weaving machine is described. This known device comprises two hooks that can be moved upwards and downwards in opposition, which can be held at a fixed height by a respectively rotatably disposed holding element. An upward and downward moving actuator comes each time on the uppermost part of its stroke between the parts of the holding elements located above the rotation spindle in order to turn these, against a spring pressure, into the holding position. A piezoelectric bending element can then freely be brought into a blocking position between the aforesaid parts of the holding elements. When the actuator is no longer between the holding elements the holding elements are held in the holding position by the bending element. The bending element can also be brought into a non-blocking position, so that the holding elements under the influence of the spring turn towards the non-holding position when the actuator is no longer between the holding elements.

Each holding element has an arm extending above the rotation spindle. When a holding element is brought into the holding position the upper extremity of the aforesaid arm is in the movement path of one of the hooks, so that this hook can hook onto the aforesaid extremity, and therefore remains at a fixed height.

Each holding element also has an arm extending under the rotation spindle. When a hook is held by the holding element, a vertically extending lateral face of the latter arm is against a vertical lateral face of a fixed stop.

A hook held by a holding element exerts a downward directed tractive force on the holding element. With the above described device, this tractive force mainly stresses the pivot point of the holding element. This results in an unacceptably high wear and tear of this pivot point.

Another disadvantage is the complexity of this device. For the turning of the holding elements three different parts are after all necessary: the upwards and downwards moving actuator, the bending element and a spring.

One object of this invention is to provide a shed forming device with the characteristics indicated in the first paragraph of this description, which is less complex, and of which the means of attachment of the movable holding elements are less stressed, than with the above described known device.

There are also shed forming devices for weaving machines, with movable holding elements that can be brought into the holding position and into the non-holding position by a piezoelectric bending element. Such a shed forming device, as has been described in the European patent application no. EP-O 544 527, has however as disadvantage that the bending element itself has to provide the necessary contact pressure between the holding element and the hook. This contact pressure is necessary in order among others to prevent the hook from falling from the holding element under influence of the harness stress acting on it. Piezoelectric bending elements however have the disadvantage that the mechanical energy that they can supply through their deforming, is very limited. When the bending elements of this device have to supply a certain additional mechanical energy, for example in order to overcome frictional forces resulting from dirt, they will no longer be in a condition to ensure the necessary contact pressure.

A further object of this invention is to obtain a shed forming device, whereby the aforesaid contact pressure is obtained, without the actuator having to supply any mechanical energy for that purpose.

Finally there are also shed forming devices for textile machines, with fixed holding elements and elastic hooks, whereby piezoelectric bending elements are used as blocking element in order to prevent an elastic hook from hooking onto a holding element. The upwards and downwards moving hook will then however each time rub over the blocking element. This causes on the one hand wear and tear, and on the other hand the pre-tensioning of the harness working together with hooks has to be sufficiently great, in order that the downward tractive force exerted on the hooks would be able to overcome the friction.

Yet another object of this invention is to obtain a shed forming device without the disadvantages of the shed forming devices mentioned in the preceding paragraph.

SUMMARY OF THE INVENTION

The aforesaid objectives are all achieved according to this invention by providing a shed forming device with the characteristics from the first paragraph of this description, and with a holding element that, while holding the shed forming means at the fixed height, is supported by the stop, so that the holding element is held on the stop by the shed forming means.

With this shed forming device, according to the invention, the means of attachment of the holding element are almost not stressed by the downward tractive force exerted by the shed forming means. This force is after all mainly transferred to the stop. Furthermore the device is also simple to construct because of the fact that only an actuator is required for the turning of the holding elements. Furthermore the necessary contact pressure between the shed forming means and the holding element is produced by the hook load itself, so that the actuator does not have to supply any mechanical energy for that purpose. Because of this the device is particularly suitable for working with a piezoelectric bending element.

Furthermore a non-selected shed forming means (i.e. not held at the fixed height) will not during its upward and downward movement come into contact with a part provided for its selection. Because of this wear and tear are limited to a minimum, while the device can operate with a small pre-tensioning of the harness.

A preferred embodiment of the shed forming device according to this invention comprises a rotatably disposed holding element with an eccentric supporting part for supporting the shed forming means.

With this embodiment the downward tractive force exerted by the shed forming means is eccentrically transferred to the holding element, so that the holding element is pulled into a stable position on the stop by the shed forming means.

With a particular embodiment of this shed forming device, for rotating the holding element into the holding position and the non-holding position, the actuator eccentrically grips onto a part of the holding element, which is under the rotation spindle when the holding element is supported by the stop. Because of this the additional advantage is achieved that the actuator also cannot be stressed.

A particular embodiment of the shed forming device has a holding element, that comprises an arm extending upwards from the rotation spindle in every position, with a supporting part bent over away from the rotation spindle. The supporting part lies on the stop and for supporting the shed forming means, is in the movement path of the shed forming means, when the holding element is brought into the holding position.

The shed forming device according to this invention is preferably produced such that the holding element, the actuator, and the stop of each shed forming mechanism are together detachable from the other parts of the device.

The other parts of the device are the shed forming means and for example the parts of a pulley device working together with the shed forming means. The replacement of the elements (the holding element, the actuator and the stop) provided for the selection (i.e. holding at the fixed height) of the shed forming means can occur in a particularly simply and quick manner, by detaching these elements together and by replacing a new set of selection elements.

With the replacement of one or several of the other parts, such as for example a pulley cord or a pulley element of the pulley device, it is also particularly advantageous that the selection elements can be separately detached and, after carrying out the replacement, can be put back.

With the most preferred embodiment of the shed forming device according to this invention the actuator is a piezoelectric bending element.

Piezoelectric bending elements under the influence of an electric voltage adopt a different bending shape depending on the polarity of the applied electric voltage. Piezoelectric bending elements use very little energy. The energy consumption is comparable to the charging energy of a small condenser. Piezoelectric bending elements furthermore also develop no heat.

The disadvantage that these bending elements can only supply a small mechanical energy, does not manifest itself with the shed forming device according to the invention, because of the fact that the bending element does not have to provide the contact pressure between the shed forming means and the holding element.

With yet another embodiment the actuator is an electromagnetic micro-relay. Since the air gap with such a relay is very small, the energy consumption will also be very small, with a minor development of heat as a result. Furthermore the relay only has to be powered for a short time, namely the time that is necessary in order to move the holding element into its stable position on the stop.

The shed forming device can be produced with shed forming mechanisms working together according to claim 8 or 9 in order to enable two positions, respectively three positions of the textile machine threads connected to it.

In a particular embodiment the holding elements, the actuators and the stops of the shed forming mechanisms working together are detachable together from the other parts of the device.

With a specific embodiment the holding elements and the actuators of the shed forming mechanisms working together are supported by a module, whereby they are disposed between two walls of this module, while a part of each holding element can extend through an opening in a respective wall to support the shed forming means, whereby an edge delimiting this opening forms the stop for the holding element.

The shed forming means of the shed forming mechanisms working together and the pulley element working together with these shed forming means can furthermore be movably supported by a separately detachable module, and are disposed between two walls of this module.

If one or several of the selection elements have to be replaced, the first mentioned module is replaced. If the pulley element or a cord working together with it has to be replaced, the last mentioned module is replaced.

These replacements can be carried out easily and quickly. There are shed forming devices in which the selection elements, the shed forming means, the pulley element, and the cords working together with it are provided in one and the same detachable module. In case of defect of one of these parts the complete module is replaced, so that a large number of intact parts are also replaced.

Because of the fact that the various parts of the shed forming device according to this invention are provided in two separately detachable modules, in case of defect of a part, a smaller number of intact parts has to be replaced.

The invention will now be further clarified in the following detailed description of a preferred embodiment thereof. In this description reference is made to the attached figures, of which

DETAILED DESCRIPTION OF THE PREFERRED EMBODIMENT

Figure 1:
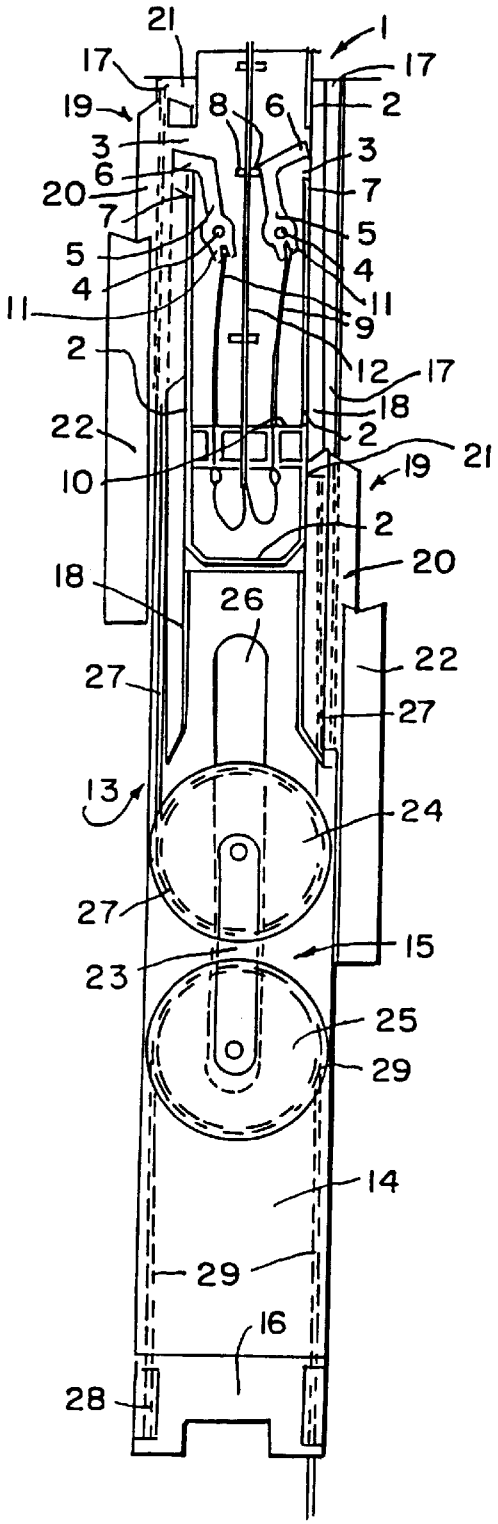
FIG. 1 is a side view of a shed forming device (without the front side walls) for a two-position-open-shed Jacquard machine.
Figure 2:
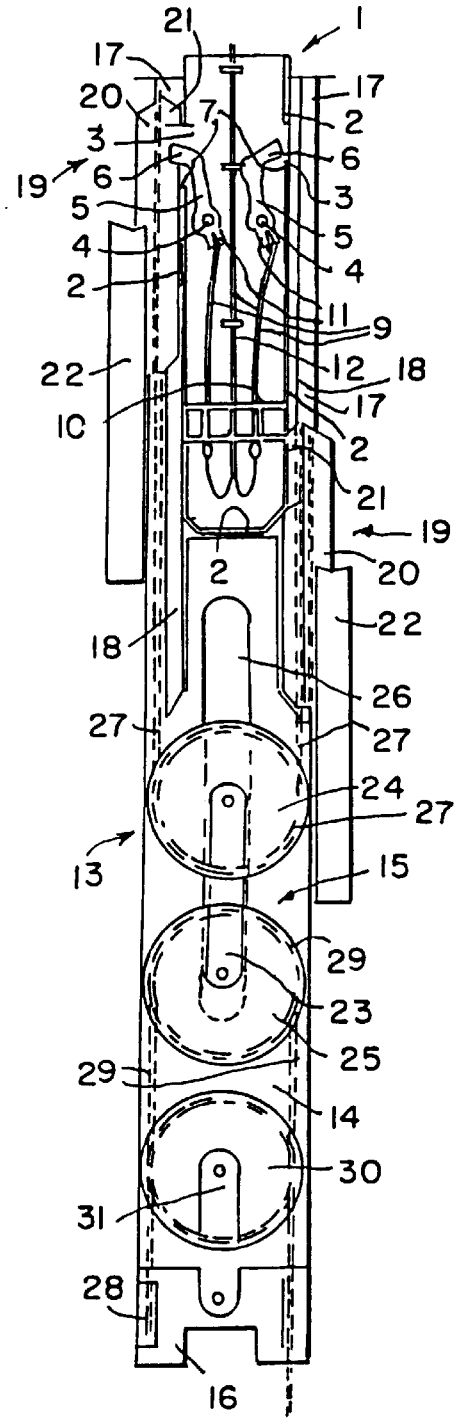
FIG. 2 is a side view of a shed forming device (without the front side walls) for a three-position-open-shed Jacquard machine.

A shed forming device for a two-position-open-shed Jacquard machine (see FIG. 1) according to this invention, includes a first module (1) with walls (2) that enclose an inner space on the sides and underneath. In FIG. 2 the front side wall of the first module (1) has been removed. In two opposite side walls (2) of the module (1) openings (3) are provided. In the inner space of the module (1) two spindles (4) are provided under the openings (2). On each spindle (4) a holding element (5) is rotatably attached. The holding elements (5) are provided with elongated arms that from the respective spindles (4) extend upwards, and which have an upper bent-over part (6). The bent-over parts (6) are opposite the openings (3) and extend in opposite directions to a respective opening (3). The holding elements (5) can turn until they are in a holding position, whereby the bent-over part (6) rests on the lower edge (7) of a respective opening (3). (The holding element (5) depicted on the left in FIG. 1 is in the holding position). This edge (7) forms a stop for supporting the holding element (1). The holding elements (5) can also turn until they are in a non-holding position, whereby they are stopped by a respective stop element (8), that is disposed centrally in the inner space of the module (1). (The holding element (5) depicted on the right in FIG. 1 is in the non-holding position).

A bimorph piezoelectric bending element (9) is disposed under each holding element (5). The bending elements (9) are securely clamped with a lower extremity in an element (10) provided in the lower part of the module (1), that connects the aforesaid opposite side walls (2).

The holding elements (5) also have a short arm (11) that extends along the other side of the spindle (4) in relation to the aforesaid elongated arm. In each short arm (11) a U-shaped groove is provided, whose open side is directed downwards.

The bending elements (9) extend upwards from the element (10), and have their upper extremity in the U-shaped groove in the short arm (11) of a respective holding element (5).

The bending elements (9) can be supplied with electric voltage via electric conductors (12) so that they achieve a first bending whereby they upper extremity brings a holding element (5) into the holding position. This is the case for the bending element (9) depicted on the left in FIG. 1. The bending elements (9) can achieve a second bending by reversing the polarity of the electric voltage, whereby their upper extremity brings a holding element (5) into the non-holding position. This is the case for the bending element (9) depicted on the right in FIG. 1.

The shed forming device also comprises a second module (13) with two opposite side walls (14) between which a pulley element (15) is attached vertically movable. In FIG. 1 the front side wall (14) has been removed. The module (13) has a bottom (16) under the pulley element (15) and two upright arms (17) above the pulley element (15).

The arms (17) extend above the side walls (14) of the second module (13). The upper edges of the side walls (14) and the arms (17) delimit a U-shaped space in which the first module (1) is detachably disposed. Each arm (17) furthermore also includes a vertical guide rail (18) for a respective hook (19).

The guide rails (18) extend to above the openings (3) in the opposite walls (2) of the first module (1).

Each hook (19) has a protruding wing (20) on the back and a protrusion (21) on top on the front. The hooks are movably disposed in the guide rails (18), with their fronts directed towards each other. On both sides of the joined together modules (1), (13) two blades (22) are provided which can be brought into an upward and downward movement in opposition by a drive device (not represented in the figures).

Moreover an upper edge of each blade (22) can grip under a lower edge of the protruding wing (20) of a respective hook (19). The hooks (19) can consequently be moved up and down in opposition by the blades (22). In the upper dead point of their movement the protrusions (21) of the hooks (19) are brought above the holding elements (5).

When the holding elements (5) are in the holding position, their bent-over parts (6) are in the movement path of the protrusion (21) of a respective hook (19).

Each time when a blade (22) is at the end of its upward movement, it can be determined whether the hook (19) working together with the blade (22) has to be held at a fixed height or has to be engaged by the blade (22), during the following movement cycle of the blade (22).

A hook (19) is after all each time brought with its protrusion (21) above the holding element (5). When the holding element (5) is subsequently brought into the holding position, the protrusion (21) will, with the following downward movement of the hook (19), arrive on the top of the bent-over part (6) of the holding element (5). The hook (19) will consequently be supported by the holding element (5) and remain above at a fixed height during the following movement cycle of the blade (22).

At the end of the following upward movement of the blade (22), the blade (22) will take the hook (19) supported by the holding element (5) along upwards to above the holding element (5).

When the holding element (5) remains in the holding position, the hook will again remain above on the holding element (5) during the following movement cycle (as described above).

When the holding element (5) on the other hand is brought into the non-holding position, the hook (19) will be engaged by the blade (22) for the following movement cycle of the blade (22), and therefore first move downwards and subsequently upwards.

The pulley element (15) has a body (23) to which two pulley wheels (24), (25) are rotatably attached above each other. The pulley element (15) is disposed between the side walls (14) of the second module (13), while the body (23) is slidable in a vertically extending groove (26) in those side walls (14).

The hooks (19) are connected to each other by an upper pulley cord (27), which runs round the upper pulley wheel (24) of the pulley element (15), so that the pulley cord (27) attached to the hooks (19) carries the pulley element (15). During the upward and downward movement of the hooks (19) the pulley element (15) remains at a first height. When one of the hooks (19) is held in an upper position, the pulley element (15) will as a result of the hoisting of the other hook (19) be brought up to a second height.

The bottom (16) of the second module (13) is provided with a means of attachment (28), to which one extremity of the lower pulley cord (29) is attached. This lower pulley cord (29) runs over the lower pulley wheel (25) of the pulley element (15) and subsequently extends downwards, where the other extremity is provided in order to form a shed between the threads of a textile machine.

Because of the fact that the pulley element (15) can be brought to two different heights, this is also the case for the hanging-down extremity of the lower pulley cord (29).

By providing a Jacquard machine with a series of shed forming devices as described above, a two-position-open-shed Jacquard machine is obtained. Such a Jacquard machine can for example be used on a weaving machine, for forming a shed between warp threads. The warp threads can be raised by harness cords, which are hung onto a hanging-down extremity of a lower pulley cord (29) of the shed forming device.

A three-position-open-shed Jacquard machine consists of two devices working together: A first device that can be seen in the side view of FIG. 2, and a second device, which is disposed next to the first device, and is therefore not visible in FIG. 2. The second device is identical to the shed forming device according to FIG. 1, without the lower pulley cord (29).

The first device (see FIG. 2) is distinguished from the device depicted in FIG. 1, because of the fact that a reversing wheel (30) is disposed in the second module (13), and because of the fact that the lower pulley cord (29) has another route. The parts from FIG. 2 that are identical to the parts from FIG. 1 are indicated by the same reference numbers.

The reversing wheel (30) is revolvingly attached to an arm (31) that is rotatably attached to the bottom (16) of the second module (13). The arm (31) can rotate in a plane (the plane of the drawing) extending parallel to the side walls (14) of the module (13).

The pulley elements (15) of the two devices working together are movably disposed in respective vertical operating planes. The pulley wheel (30) is preferably diagonally disposed between these operating planes.

One extremity of the lower pulley cord (29) is attached to the bottom (16) of the second module (13) of the first device, runs round the lower pulley wheel (25) of the pulley element (15) of the first device, subsequently runs round the reversing wheel (30), subsequently round the lower pulley wheel (25) of the pulley element (15) of the second device, and finally extends downwards, where the other extremity is foreseen for forming a shed between threads of a textile machine.

It is known how the hanging-down extremity of the lower pulley cord can be brought to three different heights with the hooks (19) of the first and the second device.

For obtaining a four-position Jacquard machine the aforesaid extremity of the lower pulley cord (29) can be attached to a movable grid, which together with one of the blades (22) can be brought to an upward and downward movement.

Figure 3:
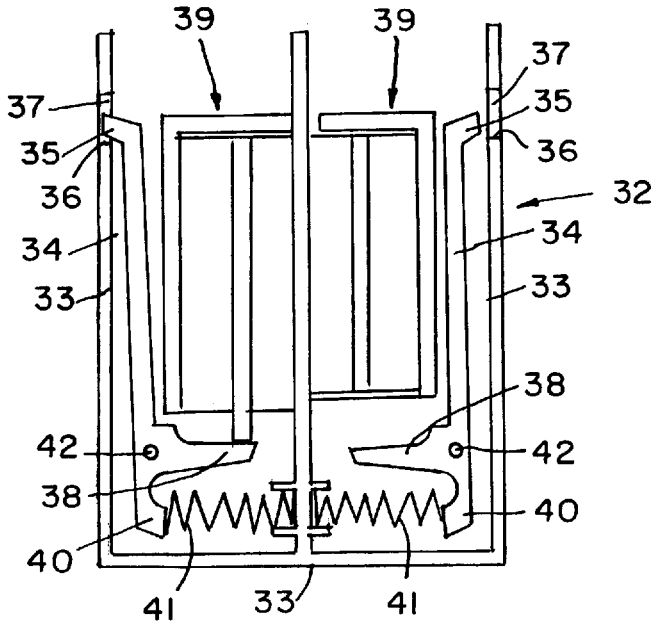
FIG. 3 is a side view of a part of the shed forming device (without the front side wall) that comprises the holding elements and an electromagnetic micro-relay.

In FIG. 3 an alternative embodiment of the first module (1) is represented in side view. This module (32) has walls (33) that enclose an inner space on the sides and underneath. (The module is represented in FIG. 3 without the front side wall).

The module (32) is furthermore also provided with openings (37) in two opposite side walls (33) and with two holding elements (34) rotatable round a spindle (42) with an upwardly directed arm that is bent over on top. The bent-over part (35) of each arm lies on the lower edge (36) of a respective opening (37) and extends out of the inner space, when the holding element (34) is brought into a holding position.

Each holding element (34) is furthermore also provided with a first short arm (38) that can be drawn by a respective electromagnetic micro-relay (39) disposed in the inner space in order to turn the holding element (34) into the holding position. Each holding element (34) also includes a second short arm (40) onto which a spring (41) grips in order to turn the holding element (34) into the non-holding position.

Each holding element (34) can hold a respective hook (19) at a fixed height in the same manner as has been described above.

In order to hold a hook (19), engaged by a blade (22), at a fixed height, a holding element (34) is turned into the holding position when the protrusion (21) of that hook (19) is above the holding element (34). With its downward movement the hook (19) arrives with its protrusion (21) on the bent-over part of the holding element (34). The downward tractive force that the hook (19) exerts on the holding element (34) holds the holding element on the stop formed by the lower edge (36) of the opening (37). From then on the relay (39) no longer has to be powered. The tractive force exerted by the hook (19) is after all sufficient in order to prevent the holding element (34) from turning back to its non-holding position under influence of the spring pressure of the spring (41).

I claim:

1. Shed forming device for a textile machine having at least one shed forming mechanism comprising a shed forming means adapted to perform an upward and downward movement, a movable holding element, an actuator connected to the holding element for moving the holding element into a holding position and into a non-holding position, and a stop for stopping the holding element in the holding position, the holding element holding the shed forming means at a fixed height in the holding position, wherein the stop supports the holding element when the element holds the shed forming means at the fixed height, and wherein the holding element is held on the stop by the shed forming means.

2. The device of claim 1, further comprising an actuator for rotatably moving the holding element, and said holding element further comprising an eccentric supporting part for supporting the shed forming means.

3. The device of claim 2, further comprising a rotation spindle connected to the holding element, wherein the actuator is connected to the holding element eccentrically below the rotation spindle for rotating the holding element into the holding position and the non-holding position when the holding element is supported by the stop.

4. The device of claim 3, wherein the holding element further comprises an arm extending upwardly from the rotation spindle in the holding and non-holding positions, said supporting part having bend away from the rotation spindle, wherein the supporting part lies on the stop for supporting the shed forming means and the supporting part lies in the movement path of the shed forming means when the holding element is in the holding position.

5. The device of claim 2, wherein the holding element, the actuator, and the stop of each shed forming mechanism are adapted to be detachable together from other parts of the device.

6. The device of claim 2, wherein the actuator is a piezoelectric bending element.

7. The device of claim 2, wherein the actuator is a piezoelectric micro-relay element.

8. The device of claim 1, further comprising at least two shed forming mechanisms working together with respective shed forming means, actuators, and stops, the mechanisms moving up and down in opposition, a pulley element having a first and a second pulley wheel, a pulley cord passing around the first pulley element and connecting the respective shed forming means to each other, and a shed cord attached to the device and passing around the second pulley wheel for forming a shed between threads of the textile machine.

9. The device of claim 8, wherein the holding elements, the actuators and the stops of the shed forming mechanisms working together, are adapted for being detachable together from other parts of the device.

10. The device of claim 8, further comprising a first pair of shed forming mechanisms working together with respective first shed forming means, actuators and stops, for moving upwardly and downwards in opposition, a second pair of shed forming mechanisms working together with respective second shed forming means for moving upwards and downwardly in opposition, wherein the first shed forming means are connected to each other by a first pulley cord that runs around a first pulley wheel of a first pulley element, and wherein the second shed forming means are connected to each other by a second pulley cord that runs around a first pulley wheel of a second pulley element, and wherein a shed forming cord is attached to a part of the device and successively runs around a second pulley wheel of the first pulley element, and around a reversing wheel attached to a part of the device, and around a second pulley wheel of the second pulley element for forming a shed between threads of the textile machine.

11. The device of claim 10, wherein the holding elements, the actuators and the stops of the shed forming mechanisms working together, are adapted for being detachable together from other parts of the device.

12. The device of claim 10, further comprising a separately detachable module wherein the holding elements and the actuators of the shed forming mechanisms working together are supported by the module and are disposed between two walls of the module, wherein a part of each holding element extends through an opening in a respective wall for supporting the shed forming means, and wherein the stops for the holding elements are formed by an edge delimiting the opening.

13. The device of claim 12, further comprising a second separately detachable module, wherein the shed forming means of the shed forming mechanisms working together, and the pulley elements working together with the shed forming means are movably supported by on the second separately detachable module and are disposed between two walls of the second module.

* * * * *